US006639618B2

(12) United States Patent
Nakamura et al.

(10) Patent No.: US 6,639,618 B2
(45) Date of Patent: Oct. 28, 2003

(54) THERMAL TRANSFER LINE PRINTER PROPERLY USED FOR FORMING INTERMEDIATE TRANSFER TYPE IMAGE

(75) Inventors: Tadashi Nakamura, Iwate-ken (JP); Toshihiko Hatakeyama, Iwate-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/144,226

(22) Filed: May 10, 2002

(65) Prior Publication Data

US 2003/0007060 A1 Jan. 9, 2003

(30) Foreign Application Priority Data

May 14, 2001 (JP) ..... 2001-143449

(51) Int. Cl.[7] ..... B41J 2/325
(52) U.S. Cl. ..... 347/213
(58) Field of Search ..... 347/171, 213

(56) References Cited

U.S. PATENT DOCUMENTS 5,053,788 A * 10/1991 Tohdo ..... 347/213
5,416,500 A * 5/1995 Tohdo ..... 347/171
5,532,724 A * 7/1996 Inagaki et al. ..... 347/213
5,798,161 A 8/1998 Kita et al.
6,377,291 B2 * 4/2002 Andoh et al. ..... 347/213
6,486,904 B1 * 11/2002 Anozato et al. ..... 347/213
2001/0010535 A1 * 8/2001 Andoh et al. ..... 347/213
2003/0025781 A1 * 2/2003 Honma et al. ..... 347/213

FOREIGN PATENT DOCUMENTS

EP 376170 A2 * 7/1990 ..... B41J/2/325
EP 566161 A2 * 10/1993 ..... B41J/2/325
EP 0 585 852 A2 3/1994
EP 589462 A1 * 3/1994 ..... B41J/2/325
JP 2000-62227 * 2/2000 ..... B41J/2/325

* cited by examiner

*Primary Examiner*—Huan H. Tran
(74) *Attorney, Agent, or Firm*—Brinks Hofer Gilson & Lione

(57) ABSTRACT

The thermal transfer line printer is provided with a controller for controlling a heating roller contact ON/OFF motor so that a heating roller contact ON/OFF mechanism is selectively operated at least in a weak pressure contact state that a heating roller is in contact with an intermediate transfer sheet with a weak pressure and in a strong pressure contact state that the heating roller is in contact with the intermediate transfer sheet with a strong pressure when retransfer is carried out.

2 Claims, 3 Drawing Sheets

THERMAL TRANSFER LINE PRINTER PROPERLY USED FOR FORMING INTERMEDIATE TRANSFER TYPE IMAGE

BACKGROUND OF THE INVENTION

1. Field of the Invention

This invention relates to a thermal transfer line printer that is suitably used for forming an intermediate transfer type image in which ink of a multi-color ink sheet is transferred on an intermediate transfer sheet by means of a line thermal head to form a primary image and the primary image is retransferred on a transfer medium to form an image on the transfer medium.

2. Description of the Related Art

Heretofore, the intermediate transfer type thermal transfer line printer for forming an image on a transfer medium by means of a method in which ink of a multi-color ink film is transferred on an intermediate transfer medium by use of a line thermal head to form a primary image and the primary image is retransferred on a transfer medium by use of retransfer means has been used widely as an output apparatus of a computer or ward processor. The reasons are that a high quality printed image can be formed easily on various transfer media such as CD, CD-R, MO, DVD, and various cards in addition to regular paper and that the intermediate transfer type thermal transfer line printer is operated with low noise, available at low cost, and needs less maintenance.

A conventional thermal transfer line printer as described hereinabove operates as described hereunder. A line thermal head is brought into down-state in which the line thermal head is brought into contact with a platen roller with interposition of an ink sheet and an intermediate transfer sheet that are formed in the configuration of long sheet in this order in a primary image forming section. Heating elements of the line thermal head are heated selectively based on the printing information with feeding the ink sheet and the intermediate transfer sheet in this state to thereby melt or sublimate the ink carried on the ink sheet so that the ink is transferred on the intermediate transfer sheet, and a reverse image that is served as the intermediate image for one page, namely one picture, is formed on the intermediate transfer sheet. Thereafter, the intermediate transfer sheet is moved and the primary image formed on the intermediate transfer sheet is concomitantly moved to the position just before the retransfer section, and then the primary image is moved to the retransfer preparation position for start alignment with aid of the register mark formed on the intermediate transfer sheet so that the primary image is registered with a transfer medium. Then, the primary image formed on the intermediate transfer sheet is melted or sublimated by applying heat and pressure of retransfer means comprising a heating roller in a retransfer section, and the primary image is retransferred and fixed on the transfer medium to thereby form a desired image on the transfer medium.

At that time, in the case where a monochrome image of one color is formed on a transfer medium, one pass is enough for forming an image.

On the other hand, in the case where a multi-color image is formed on a transfer medium, an multi-color intermediate image is formed by means of so-called swing-back technique as described hereunder. A multi-color ink sheet on which a plurality of color ink regions are arranged so that different colors are repeated adjacently in the longitudinal direction is used as an ink sheet. At first, a reverse image of the first color ink that is carried on the multi-color ink sheet is formed on an intermediate transfer sheet. Then, a line thermal head is brought into head-up state in which the line thermal head is being separated from a platen, and the intermediate transfer sheet is moved reversely to the transfer preparation position in this state. The reverse image formed with the first color ink is returned to the transfer position for start alignment, and a reverse image of the next color is transferred on the reverse image of the first color one on the other.

In detail, in the case where a full-color image is formed, a multi-color ink sheet on which a plurality of ink regions, each of which consists of four colors, for example, K (black), Y (yellow), M (magenta), and C (cyan) are arranged so that the different colors are repeated adjacently in the longitudinal direction and which has color-discrimination marks on the boundary between different ink regions is used as an ink sheet.

More in detail, at first, a K-color reverse image for one page picture is formed on an intermediate transfer sheet by use of a K-color ink region on the multi-color ink sheet. Next, the intermediate transfer sheet that has been moved during the primary image forming operation is moved in the reverse direction to the transfer preparation position to align the K-color reverse image formed on the intermediate transfer sheet, and a Y-color ink region that is positioned adjacent to the K-color ink region of the multicolor ink sheet is aligned. With the use of the Y-color region in the multi-color sheet, a Y-color reverse image for one page picture is formed over the K-color reverse image for one page picture that has been formed on the intermediate transfer sheet. Similarly, reverse images of an M-color ink region and a C-color ink region are formed on the intermediate transfer sheet in this order to thereby form a full-color primary image for one page picture on the intermediate transfer sheet.

The register mark that has been formed on an intermediate transfer sheet previously or is formed simultaneously when a primary image is formed on an intermediate sheet. The primary image is formed on an intermediate transfer sheet so as to register with the register mark, and the primary image formed on the intermediate transfer sheet so as to register with the same register mark is retransferred so as to register with a transfer medium.

However, in the case of the above-mentioned conventional thermal transfer line printer, because a heating roller is in contact with pressure on a transfer medium, more in detail, on the head portion of the transfer medium with respect to the moving direction with interposition of an intermediate transfer sheet when retransferring is carried out, a load is applied abruptly on the intermediate transfer sheet. As the result, the portion that is in contact with the head portion of the intermediate transfer sheet with respect to the moving direction of the transfer medium on which a primary image has been formed is cockled, the tail portion with respect to the moving direction of the transfer medium is lifted upward from a tray surface due to the pressure force of the heating roller applied on the head portion with respect to the moving direction of the transfer medium, and a high quality image is formed on the transfer medium not consistently. If an intermediate transfer sheet is cockled, a primary image located on the cockled portion is not retransferred on a transfer medium to cause partial lack of image.

Furthermore, in the case of the conventional thermal transfer line printer, a register mark is detected in the state that a heating roller is being separated from an intermediate transfer sheet, an intermediate image on the intermediate transfer sheet is moved to the retransfer preparation position for start alignment, and then the heating roller is brought into contact with the intermediate transfer sheet. As the result, the tension of the intermediate transfer sheet changes at the portion that is in contact with the heating roller due to the load applied on the intermediate transfer sheet when the heating roller is brought into contact with the intermediate transfer sheet, the primary image that has been registered with the transfer medium deviates from the transfer medium, and a high quality image is formed on the transfer medium not consistently.

SUMMARY OF THE INVENTION

The present invention has been accomplished in view of the abovementioned problem, and it is the object of the present invention to provide a thermal transfer line printer that is capable of forming a high quality image on a transfer medium consistently.

To accomplish the abovementioned object, a thermal transfer line printer in accordance with the present invention is characterized by providing a controller for controlling a heating roller contact ON/OFF motor so that a heating roller contact ON/OFF mechanism is selectively operated at least in a weak pressure contact state that a heating roller is in contact with an intermediate transfer sheet with a weak pressure and in a strong pressure contact state that the heating roller is in contact with the intermediate transfer sheet with a strong pressure when retransfer is carried out. By employing the abovementioned structure, when retransfer is carried out, the pressure applied when the heating roller is in contact with the intermediate transfer sheet can be applied at least two-step wise so as to be weak at first and so as to be strong later. Thereby, the load change applied on the intermediate transfer sheet can be made gradual. As the result, cockling on the intermediate transfer sheet at the portion that is in contact with the head of the transfer medium in the moving direction is prevented, and lifting-up of the tail portion of the transfer medium in the moving direction from the tray surface is prevented. Therefore, a high quality image is formed on a transfer medium consistently.

It is preferable that the abovementioned thermal transfer line printer is provided with retransfer mark detection means for detecting a register mark formed on the intermediate transfer sheet when retransfer is carried out, and the controller controls an operation timing so that the heating roller is pressed with a weak pressure at a time before the retransfer mark detection means detects a register mark and the heating roller is pressed with a strong pressure at a time after the retransfer mark detection means detects the register mark when the retransfer is carried out. By employing the abovementioned structure, because a register mark can be detected in a state that the heating roller is in the weak pressure contact with the intermediate transfer sheet, when the retransfer is carried out, the positional deviation between the primary image and the transfer medium caused when the heating roller is brought into contact with the intermediate transfer sheet with pressure, which have been registered, due to a load applied on the intermediate transfer sheet is prevented consistently. Therefore, a high quality image can be formed on a transfer medium more consistently.

BRIEF DESCRIPTION OF THE INVENTION

DETAILED DESCRIPTION OF THE PREFERRED EMBODIMENTS

The present invention will be described according to the embodiment in detail hereinafter with reference to the drawings.

Figure 1:
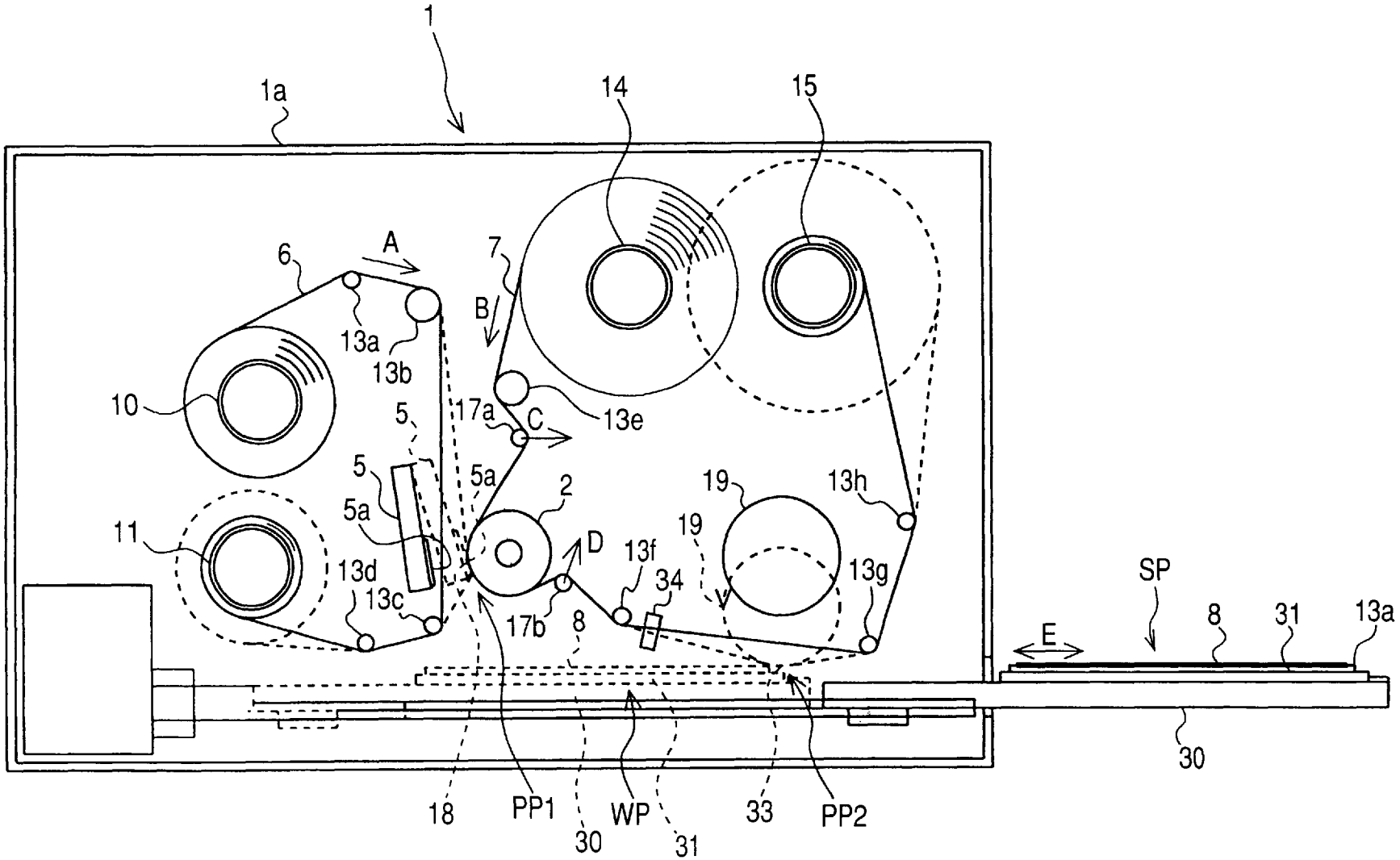
FIG. 1 is a partial front view showing the whole structure of an embodiment of a thermal transfer line printer in accordance with the present invention.
Figure 2:
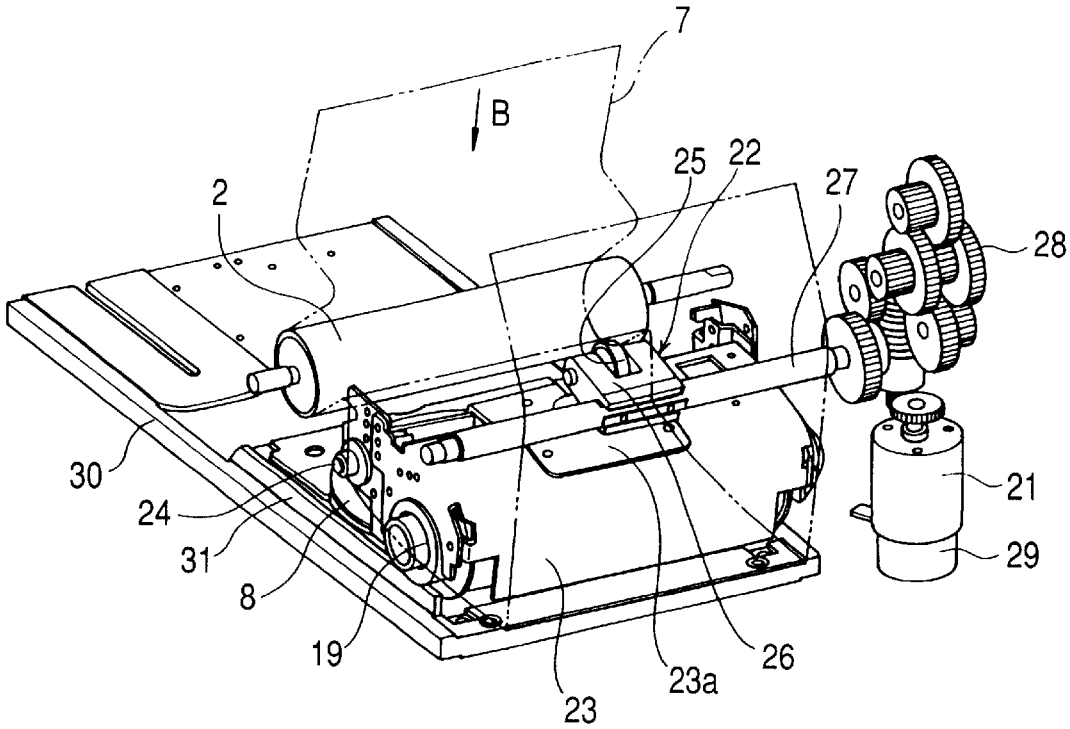
FIG. 2 is a perspective view showing the structure located near the heating roller of FIG. 1.
Figure 3:
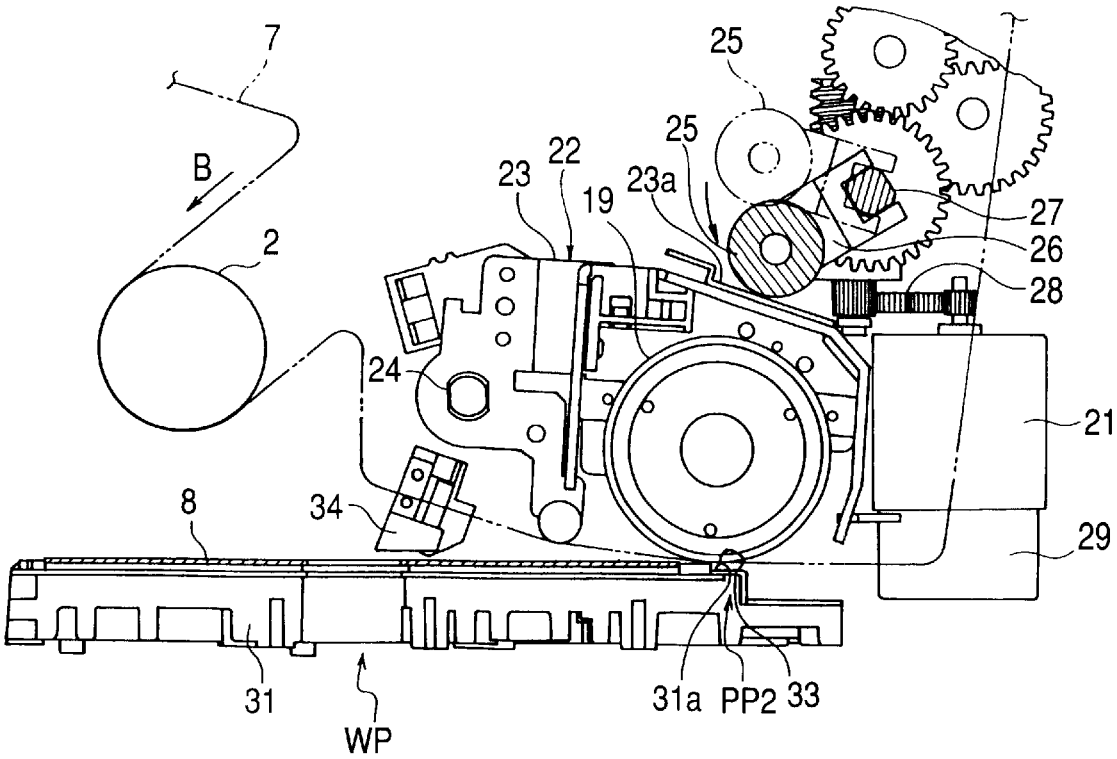
FIG. 3 is an enlarged view showing the pressure contact state in which the heating roller is in contact with an intermediate transfer sheet.
Figure 4:
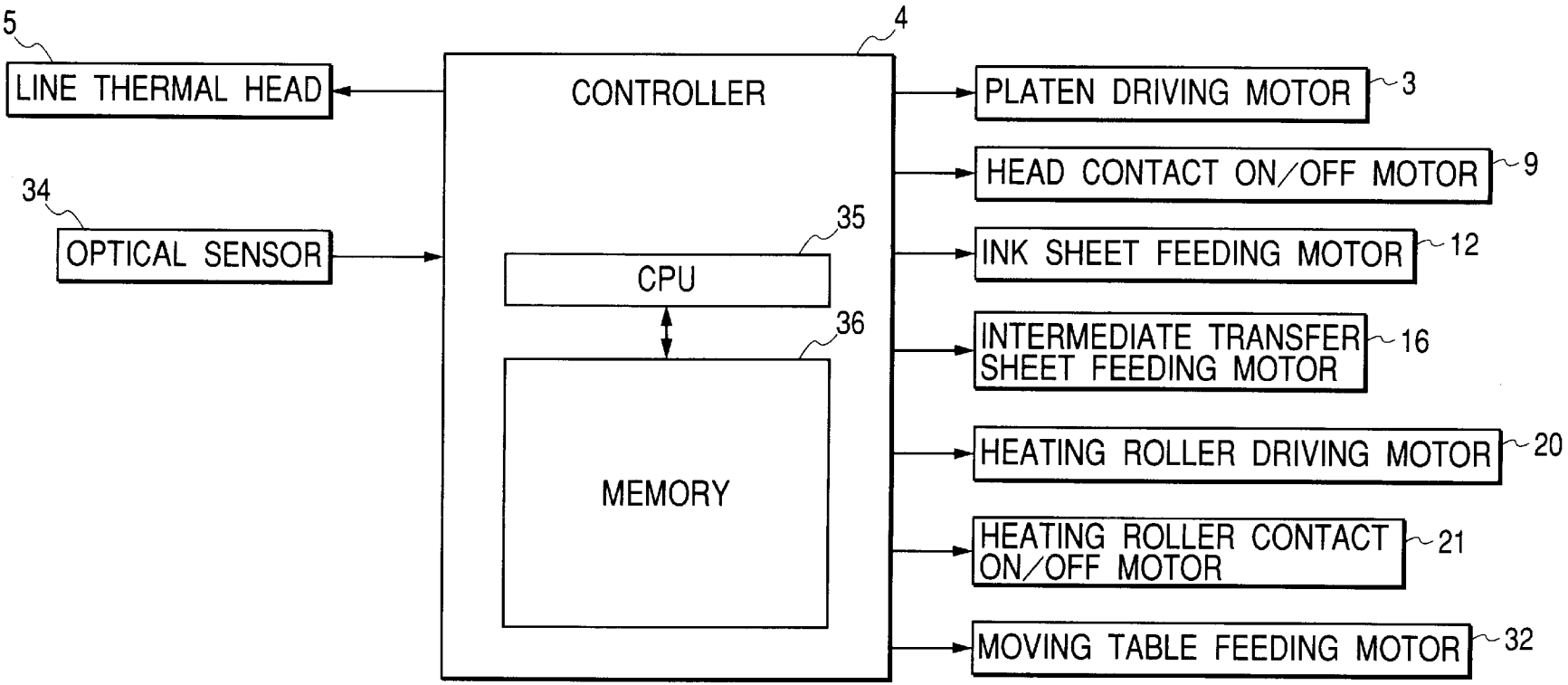
FIG. 4 is a block diagram showing the partial structure of a controller.

FIG. 1 to FIG. 4 show an embodiment of a thermal transfer line printer in accordance with the present invention. FIG. 1 is a partial front view showing the whole structure, FIG. 2 is a perspective view showing the portion located near a heating roller shown in FIG. 1, FIG. 3 is an enlarged cross sectional view showing the contact state in which the heating roller is in contact with an intermediate transfer sheet, and FIG. 4 is a block diagram showing the partial structure of a controller.

An exemplary thermal transfer line printer of the present embodiment is served to form a full-color image by use of a multi-color ink sheet on which four-color ink regions formed of four color inks, namely K, Y, M, and C, are arranged repeatedly in this order so that the different colors are located adjacently in the longitudinal direction and on which the color-discrimination mark is formed on the boundary between respective ink regions.

As shown in FIG. 1, a platen roller 2 is provided rotatably in a printer body 1*a* of the thermal transfer line printer 1 of the present embodiment. The platen roller 2 is rotatably formed by receiving transmission of driving force of a platen driving motor 3 (FIG. 4) such as a stepping motor. The platen driving motor 3 is connected electrically to a controller 4 (FIG. 4) that is served to control the operation of other sections described hereinafter, and the stopping, starting, rotation speed, and rotation direction are controlled based on the control command sent out from the controller 4.

A line thermal head 5 that can be brought into contact with and detached from the platen roller 2 is provided on the left side of the platen roller 2 shown on the left in FIG. 1 so as that a printing surface 5*a* faces to the outer peripheral surface of the platen roller 2. The line thermal head 5 extends in the direction parallel to the axial direction of the platen roller 2. Furthermore, on the printing surface 5*a* of the line thermal head 5, a plurality of heating elements (not shown in the drawings) are arranged over the length equivalent to the size of the multi-color ink sheet 6 and the size of the intermediate transfer sheet 7 in the direction orthogonal to the moving direction of the multiple-color ink sheet 6 shown by the arrow A shown in FIG. 1 and in the direction orthogonal to the moving direction of the intermediate transfer sheet 7 shown by the arrow B shown in FIG. 1. Furthermore, the line thermal head 5 is connected electrically to the controller 4 that will be described hereinafter, and each heating element is heated selectively based on the control command sent out from the controller 4 according to the printing information.

The line thermal head 5 is fabricated so as to be positioned at least at two positions selectively by means of ahead contact ON/OFF mechanism, not shown in the drawings, that is operated by means of driving force of the head contact ON/OFF motor 9 (FIG. 4). One position is the head-up position in which the head is positioned at the up-position, that is, the head is separated from the platen roller 2 as shown with a solid line in FIG. 1, and the other position is the head-down position in which the head is positioned at the down-position, that is, the head is in contact with the platen roller 2 with pressure as shown with a broken line in FIG. 1. The head contact ON/OFF motor 9 is connected electrically to the controller 4 that is served to control the operation of other sections that will be described hereinafter, and the position of the line thermal head 5 is controlled based on the control command sent out from the controller 4 at the desired timing.

The multi-color ink sheet 6 and the intermediate transfer sheet 7 are supplied in the order from the line thermal head 5 side between the platen roller 2 and the line thermal head 5.

The multi-color ink sheet 6 is wound between the ink sheet feeding roller 10 disposed in the printer body 1*a* near the left portion of FIG. 1 and an ink sheet winding roller 11 disposed under the ink sheet feeding roller 10. The multi-color ink sheet 6 is sent out from the ink sheet feeding roller 10 by at least rotating the ink sheet winding roller 11 by means of driving force of an ink sheet feeding motor 12 (FIG. 4) comprising a stepping motor, and is wound on the ink sheet winding roller 11. Furthermore, the moving path and moving direction of the multi-color ink sheet 6 to be sent out by the ink sheet feeding roller 10 are controlled so as to be wound on the ink sheet winding roller 11 through four guide rollers disposed rotatably in the printer body 1*a* in the order from 13*a*, to 13*b*, 13*c*, and 13*d* as shown with an arrow A in FIG. 1. Furthermore, the moving path of the multi-color ink sheet 6 is formed so that the back surface side on which the ink region (not shown in the drawing) is not formed faces to the line thermal head 5. Furthermore, the ink sheet feeding motor 12 is connected electrically to the controller 4 for controlling the operation of other sections that will be described hereinabove, and the stop, start, and rotation speed of the ink sheet feeding motor 12 is controlled based on the control command supplied from the controller 4.

On the other hand, the intermediate transfer sheet 7 is wound between an intermediate transfer sheet feeding roller 14 disposed at a place located above and slightly right from the platen roller 2 in the printer body 1*a* and a intermediate transfer sheet winding roller 15 disposed near the upper right corner in FIG. 1 in the printer body 1*a*. Furthermore, at least the intermediate transfer sheet 7 is sent out from the intermediate transfer sheet feeding roller 14 by rotating the intermediate transfer sheet winding roller 15 by means of driving force of an intermediate transfer sheet feeding motor 16 (FIG. 4), and wound on the intermediate transfer sheet winding roller 15.

Furthermore, the intermediate transfer sheet 7 sent out from the intermediate transfer sheet feeding roller 14 is controlled so as to be moved as described hereunder. As shown with an arrow B in FIG. 1, the intermediate transfer sheet 7 is moved through a guide roller 13*e* and a tension roller 17*a* rotatably disposed in the printer body 1*a* in this order, moved along the outside surface of the platen roller 2, then moved through a tension roller 17*b* that is disposed rotatably in the printer body 1*a* and three guide rollers 13*f*, 13*g*, and 13*h* in this order, and then wound on the intermediate transfer sheet winding roller 15.

The two tension rollers 17*a* and 17*b* disposed on both sides of the platen roller 2, which are located so as to face to the moving path of the intermediate transfer sheet 7, are served to maintain the tension of the intermediate transfer sheet 7 constant. The tension roller 17*a* disposed at a place located above the platen roller 2 is in contact with the intermediate transfer sheet 7 so as to press the intermediate transfer sheet 7 from the left side to the right side in FIG. 1 as shown with an arrow C in FIG. 1. On the other hand, the tension roller 17*b* disposed on the left side of the platen roller 2 is in contact with the intermediate transfer sheet 7 so as to press the intermediate transfer sheet 7 from the under position toward upper right direction in FIG. 1 as shown with an arrow D in FIG. 1.

In the case of the structure that the intermediate transfer sheet 7 is not moved reversely, only the tension roller 17*b* disposed on the winding side, namely right side of the platen roller 2, may be provided.

A moving path is formed so that the intermediate transfer sheet 7 is brought into contact with the multi-color ink sheet 6 at the contact position with the platen roller 2, and the intermediate transfer sheet 7 faces to the ink region of the multi-color ink sheet 6 at the contact position.

The intermediate transfer sheet feeding roller 14 and the intermediate transfer sheet winding roller 15 are formed rotatably so as to be rotated by means of driving force of one intermediate transfer sheet moving motor 16 comprising a step motor that is rotatable reversely. For example, the driving force of the intermediate transfer sheet feeding motor 16 is formed so as to be transmitted selectively to any one of an intermediate transfer sheet feeding roller driving gear and an intermediate transfer sheet winding roller driving gear through a rockable gear disposed on the output end of a gear train (not shown in the drawings). The driving force of the intermediate transfer sheet feeding motor 16 drives the intermediate transfer sheet winding roller driving gear so as to be rotated to thereby send out the intermediate transfer sheet 7 from the intermediate transfer sheet feeding roller 14, and the intermediate transfer sheet 7 is wound on the intermediate transfer sheet winding roller 15. On the other hand, when the intermediate transfer sheet feeding roller driving gear is rotated reversely by means of the driving force of the intermediate transfer sheet feeding motor 16, the intermediate transfer sheet 7 is moved reversely from the intermediate transfer sheet winding roller 15 side to the intermediate transfer sheet feeding roller 14 side. Otherwise, the intermediate transfer sheet feeding roller and the intermediate transfer sheet winding roller may be driven by separate intermediate transfer sheet feeding motors 16 independently.

The intermediate transfer sheet 7 used in the present embodiment comprises a long transparent resin film or resin sheet consisting of polyethyleneterephthalate (PET) material or such film or sheet on which some material is coated for easy subsequent retransfer. Furthermore, the size of the intermediate transfer sheet 7 in the width direction orthogonal to the moving direction shown with an arrow B in FIG. 1 is approximately equal to the size of the multi-color ink sheet 6 in the width direction. Various materials such as thin papers and resin films may be used as the intermediate transfer sheet 7 as long as ink can be transferred from the multi-color ink sheet 6 and the ink that has been transferred on the intermediate transfer sheet 7 can be retransferred on a transfer medium 8.

The abovementioned platen roller 2 and the line thermal head 5 constitute the primary image forming section 18 that is served for transferring the ink of the multi-color ink sheet 6 of the present embodiment on the intermediate transfer sheet 7 to form a primary image (not shown in the drawing) comprising a reverse image on the intermediate transfer sheet 7.

Furthermore, in the head-down state shown with a broken line shown in FIG. 1 in which the line thermal head 5 is in contact with the platen roller 2 with a certain contact force, the contact position between the thermal head 5 and the platen roller 2 is the intermediate transfer position PP1 where the ink of the multi-color ink sheet 6 is transferred on the intermediate transfer sheet 7 to thereby form a primary image comprising a reverse image on the intermediate transfer sheet 7.

On the downstream side in the moving direction of the intermediate transfer sheet 7 from the intermediate image forming section 18, more in detail between two guide rollers 13*f* and 13*g* disposed on the right side from the position of the platen roller 2 in FIG. 1, a heating roller 19 that is served as the retransfer means is disposed so as to face to the moving path of the intermediate transfer sheet 7 from the above. The heating roller 19 is rotated by means of transmission of the driving force of a heating roller driving motor 20 (FIG. 4) such as a stepping motor. Furthermore, the heating roller 19 is structured so as to be positioned selectively at least at two positions, namely a separate position in which the heating roller 19 is apart from the intermediate transfer sheet 7 as shown with a solid line in FIG. 1 and a contact position in which the heating roller 19 is in contact with the intermediate transfer sheet 7 with pressure as shown with a broken line in FIG. 1, by means of a heating roller contact ON/OFF mechanism 22 that is driven by the driving force of the heating roller contact ON/OFF motor 21 (FIG. 4) that will be described hereinafter. The heating roller driving motor 20 and the heating roller contact ON/OFF motor 21 are connected electrically to the controller 4 served to control the operation of other sections that will be described hereinafter, and the rotation of the heating roller 19 and the position of the heating roller 19 are controlled at the desired timing based on the control command sent out from the controller 4.

Then, a heating roller contact ON/OFF mechanism 22 of the present embodiment will be described with reference to FIG. 2 and FIG. 3.

As shown in FIG. 2 and FIG. 3, the heating roller contact ON/OFF mechanism 22 has a heating roller support frame 23 that is served to support the heating roller 19 on both ends rotatably. As shown in FIG. 3, the heating roller support frame 23 is disposed rotatably round the rotation shaft 24 that is supported rotatably on amounting frame (not shown in the drawings). Furthermore, the heating roller support frame 23 is pressed normally in the anti-clockwise direction in FIG. 3 round the shaft center of the rotation shaft 24 by means of pressing force of a pressing spring (not shown in the drawings). The heating roller 19 is maintained apart above the intermediate transfer sheet 7 with a certain distance normally as shown in FIG. 1 by restricting the rotation of the heating roller support frame 23 in the anti-clockwise direction by use of a stopper (not shown in the drawings) Furthermore, a roller-like pressure contact member 25 that can be in ON/OFF contact with the heating roller support frame 23 is disposed above the top plate 23*a* of the heating roller support frame 23. The pressure contact member 25 is supported rotatably inside the fork-shaped top end of a pressure support member arm 26. The base end of the pressure contact member support arm 26 is fixed to a rotation support shaft 27 that is supported rotatably on a mounting frame (not shown in the drawings), and the rotation support shaft 27, which is connected to the heating roller contact ON/OFF motor 21 with interposition of the gear train 28, can be rotated by means of driving force of the heating roller contact ON/OFF motor 21.

The pressure contact member 25 is maintained apart from the top plate 23*a* of the heating roller support frame 23 while the heating roller 19 that is shown with a solid line in FIG. 1 is being separated from the intermediate transfer sheet 7, namely in separated state or at separated position. On the other hand, the pressure contact member 25 is maintained in contact with the top plate 23*a* of the heating roller support frame 23 as shown with a solid line in FIG. 3 while the heating roller 19 shown with a broken line in FIG. 1 is being in contact with the intermediate transfer sheet 7 with pressure, namely in a pressure contact state or at a pressure contact position.

In other words, the pressure contact member 25 is brought into ON/OFF contact with the top plate 23*a* of the heating roller support frame 23 by driving the heating roller contact ON/OFF motor 21, and the heating roller support frame 23 is thereby rotated round the rotation shaft 24. As the result, anyone of the separated position in which the heating roller 19 is separated from the intermediate transfer sheet 7 and the pressure contact position in which the heating roller 19 is in contact with the intermediate transfer sheet 7 can be selected.

Furthermore, the heating roller contact ON/OFF motor 21 is provided with an encoder 29, and the encoder 29 detects the rotation speed of the heating roller contact ON/OFF motor 21 and transmits a detection signal to the controller 4.

Any one pressure contact state of the weak pressure contact state and the strong pressure contact state of the heating roller 21 is selectable desiredly in the present embodiment as described hereinafter.

The heating roller contact ON/OFF mechanism 22 is by no means limited to the heating roller contact ON/OFF mechanism 22 described in the present embodiment, but any heating roller contact ON/OFF mechanism 22 may be employed as long as the heating roller 19 can be brought into ON/OFF contact with the intermediate transfer sheet 7 by means of the driving force of the heating roller contact ON/OFF motor 21.

A transfer medium 8, a compact disk (CD) is used in the present embodiment, is supplied under the heating roller 19 with interposition of the intermediate transfer sheet 7. The transfer medium 8 is mounted detachably on a tray 31 fixed on the top surface of the flat moving table 30, and the moving table 30 is moved in the right and left direction reciprocally as shown with an arrow E in FIG. 1 by means of the driving force of a moving table moving motor 32 (FIG. 4). The moving table 30 is moved reciprocally by means of the driving force of the moving table moving motor 32 so that the transfer medium 8 can be reciprocated between at least two positions, namely the supply/taking out position SP shown with a solid line in FIG. 1 and the retransfer preparation position WP shown with a broken line in FIG. 1. Furthermore, as shown in FIG. 3, the tray 31 faces to the heating roller 19 at the retransfer preparation position WP, and the portion of the upper surface that is facing to the heating roller 19 located nearest to the heating roller 19 side, namely the edge 31*a* located right in FIG. 3 near the supply/taking out position SP side, is faced to the bottom end of the heating roller 19 in the pressure contact state.

Furthermore, the moving table moving motor 32 is connected electrically to the controller 4 that is served to control the operation of other sections that will be described hereinafter, the operation such as stop, start, rotation speed, and rotation direction is controlled based on the control command sent out from the controller 4.

The transfer medium 8 is drawn out from the printer body 1*a* in the supply/taking out position SP as shown with a solid line in FIG. 1, and the transfer medium 8 can be supplied on the tray 31 and can be taken out from the tray 31 easily.

The transfer medium 8 is by no means limited to CD, and other media such as various optical disks including CD-R, MO, and DVD, and various cards such as cash card, credit card, pre-paid card, and IC card may be used. Any material may be used for the transfer medium 8 as long as the material is not deformed when it is heated for retransferring.

A retransfer section 33 that is served to retransfer the primary image formed on the intermediate transfer sheet 7 of the present embodiment to the transfer medium 8 to thereby form an image on the transfer medium 8 comprises the heating roller 19.

The pressure contact position shown with a broken line in FIG. 1 where the heating roller 19 presses the transfer medium 8 with a certain contact pressure is the retransfer position PP2 where the primary image formed on the intermediate transfer sheet 7 is retransferred on the transfer medium 8 to thereby form an image on the transfer medium 8.

As shown in FIG. 3, between the platen roller 2 and the heating roller 19, more in detail between the guide roller 13*f* and the heating roller 19, an optical sensor (reflection type optical sensor) 34 that is served as retransferring mark detection means for detecting a register mark formed on the intermediate transfer sheet 7 is disposed so as to face to the moving path of the intermediate transfer sheet 7 from the above to register the intermediate image for retransferring. The optical sensor 34 is connected electrically to the controller 4 that is served to control the operation of other sections that will be described hereinafter, and transmits a detection signal to the controller 4 when the optical sensor 34 detects a register mark.

As shown in FIG. 4, the thermal transfer line printer 1 of the present embodiment has the controller 4 that is served to control the operation of other sections, and the controller 4 comprises at least a CPU 35 and a memory 36 such as ROM or RAM having a proper capacity. The controller 4 is connected electrically to at least the platen driving motor 3, line thermal head 5, head contact ON/OFF motor 9, ink sheet feeding motor 12, intermediate transfer sheet moving motor 16, heating roller driving motor 20, heating roller contact ON/OFF motor 21, moving table moving motor 32, optical sensor 34, alarm means such as indicating lamp or buzzer for notifying an error to an operator (not shown in the drawings), and known various switches such as power source switch and switches that relate to the printing operation.

The memory 36 stores a program for controlling the heating roller contact ON/OFF motor 21 so that the heating roller contact ON/OFF mechanism 22 can select desiredly any one pressure contact state at least from among the weak pressure contact state in which the heating roller 19 is in contact with the intermediate transfer sheet 7 with a weak pressure and the strong pressure contact state in which the heating roller 19 is in contact with the intermediate transfer sheet 7 with a strong pressure at least when the retransfer is carried out.

Furthermore, the program preferably functions to control the operation timing so that the heating roller 19 is pressed with a weak pressure at the time before the optical sensor 34 detects a register mark and the heating roller 19 is pressed with a strong pressure at the time after the optical sensor 34 detects a register mark when the retransfer is carried out.

In other words, the heating roller 19 is changed from the weak contact pressure state to the strong contact pressure state preferably at the timing when the transfer medium 8 reaches to the retransfer position PP2 and the head of the transfer medium 8 in the moving direction that is being moved from the retransfer preparation position WP toward the supply/taking out position SP reaches to the retransfer position PP2.

The weak pressure contact/strong pressure contact control according to the program is carried out by detecting the rotation speed of the heating roller contact ON/OFF motor 21 by means of the encoder 29.

In detail, the rotation speed of the heating roller contact ON/OFF motor 21 is maintained constant when the pressure contact member 25 is apart from the top plate 23*a* of the heating roller support frame 23 because no lead is loaded on the heating roller contact ON/OFF motor 21. On the other hand, when the pressure contact member 25 is brought into contact with the top plate 23*a* of the heating roller support frame 23 and a load is loaded resultantly on the heating roller contact ON/OFF motor 21, the rotation speed slow downs gradually. Based on the above-mentioned fact, the relation between the rotation speed and pressure contact force has been measured previously, the point at which the rotation speed reaches to a certain predetermined rotation speed after the rotation speed starts to slow down is regarded as the weak pressure contact position, and the position at which the rotation proceeds by a certain predetermined number of pulses further from the weak pressure contact position is regarded as the strong pressure contact position. Thereby, the operation timing of the heating roller 19 is controlled so as to be switched between the strong pressure contact state and the weak pressure contact state based on the time point when the optical sensor 34 detects a register mark.

Furthermore, the memory 36 stores programs for controlling the operation and the operation sequences of various sections and various programs such as a program for initialization that is to be carried out when a power source is switched on, and data such as data required when the intermediate transfer and retransfer are carried out.

Next, the operation of the present embodiment having the abovementioned structure will be described hereunder.

Because the image forming operation on the transfer medium 8 carried out by means of the thermal transfer line printer 1 of the present embodiment is the same as that carried out by means of the conventional thermal transfer line printer, the detailed description is omitted, and only the description that relates to the essential operation of the present invention is presented herein.

According to the thermal transfer line printer 1 of the present embodiment, when the retransfer is carried out, at the time point before the optical sensor 34 detects a register mark formed on the intermediate transfer sheet 7, for example, at the time point when an intermediate image formed on the intermediate transfer sheet 7 is sent out from the intermediate transfer position PP1 toward the retransfer position PP2, the heating roller contact ON/OFF motor 21 is driven in response to a control command supplied from the controller 4, and the pressure contact member 25 is rotated in the anti-clockwise direction in FIG. 3 round the rotation support shaft 27. On the way of rotation of the pressure contact member 25 in the anti-clockwise direction in FIG. 3 round the rotation support shaft 27, the pressure contact member 25 is brought into contact with the top plate 23*a* of the heating roller support frame 23 from the above, a load is loaded on the heating roller contact ON/OFF motor 21. When the encoder 29 detects that the rotation reaches to a certain predetermined rotation speed after the rotation speed of the heating roller contact ON/OFF motor 21 starts to slow down, the driving of the heating roller contact ON/OFF motor 21 is stopped, and the heating roller 19 is maintained in weak pressure contact with the intermediate transfer sheet 7 from the above.

At that time, the transfer medium 8 has been moved to the tray 31 positioned at the retransfer preparation position WP as shown in FIG. 3, the edge 31*a* of the tray 31 is in contact with the bottom end of the heating roller 19 that is in the weak pressure contact state. The intermediate transfer sheet 7 is moved in the state that the heating roller 19 is in contact with the intermediate transfer sheet 7 in the weak pressure contact state, and on the way of moving of the primary image formed on the intermediate transfer sheet 7 from the intermediate transfer position PP1 to the retransfer position PP2, the register mark positioned on the head side in the moving direction of the primary image is detected by means of the optical sensor 34. Herein, in the state that the heating roller 19 is in contact with the intermediate transfer sheet 7, the heating roller 19 is also driven rotationally when the intermediate transfer sheet 7 is moved.

Next, when the register mark of the intermediate transfer sheet 7 is detected by means of the optical sensor 34, the head of the primary image in the moving direction is moved so as to be positioned at the head of the transfer medium 8 held on the tray 31, that is, the alignment is carried out according to a control command from the controller 4. Thereby, the intermediate image of the intermediate transfer sheet 7 is registered with the transfer medium 8 at the retransfer preparation position WP.

Next, the intermediate transfer sheet moving motor 16 and the moving table moving motor 32 are driven so that the moving speed of the intermediate transfer sheet 7 is equal to the moving speed of the moving table 30, and the primary image and the transfer medium 8 are moved at the same speed. When the intermediate transfer sheet 7 and the moving table 30 are moved, the heating roller 19 is also concomitantly driven rotationally. When the respective heads in the moving direction of the primary image and the transfer medium 8 reach the retransfer position PP2, the primary image is pressed with heating by means of the heating roller 19 so as to be retransferred on the transfer medium 8, and a desired image is formed on the transfer medium 8. Furthermore, at that time, the heating roller contact ON/OFF motor 21 is driven in response to a control command supplied from the controller 4, the heating roller 19 is brought into contact with the transfer medium 8 with a strong pressure, and the retransfer is carried out consistently.

The position where the heating roller 19 is brought into the strong pressure contact state is properly located at the position where the pressure contact area width of the heating roller becomes wide, namely the position where the head of the transfer medium 8 in the moving direction moves beyond the retransfer position PP2 slightly, in the case where the transfer medium 8 is a disk-like medium such as an optical disk. On the other hand, in the case where the transfer medium 8 is a rectangular medium such as a card, it is proper to press the transfer medium 8 strongly from the head because the pressure contact area width of the heating roller 19 does not change.

As described hereinabove, according to the thermal transfer line printer 1 of the present embodiment, the pressure applied when the heating roller 19 is in contact with the intermediate transfer sheet 7 is applied two-step wise so as to be weak at first and so as to be strong later. Thereby, the load change applied on the intermediate transfer sheet 7 can be made gradual. As the result, cockling on the intermediate transfer sheet 7 at the portion that is in contact with the head of the transfer medium 7 in the moving direction is prevented, and lifting-up of the tail portion of the transfer medium 8 in the moving direction from the tray 31 surface is prevented.

Furthermore, according to the thermal transfer line printer 1 of the present embodiment, because a register mark can be detected in the state that the heating roller 19 is in the weak pressure contact with the intermediate transfer sheet 7 when the retransfer is carried out, the positional deviation between the primary image and the transfer medium 8, which have been registered, due to a load applied on the intermediate transfer sheet 7 when the heating roller 19 is brought into contact with the intermediate transfer sheet 7 with pressure is prevented consistently.

Therefore, according to the thermal transfer line printer 1 of the present embodiment, a high quality image is formed on the transfer medium 8 consistently.

The present invention is by no means limited to the abovementioned embodiment, various modifications may be applied as required.

As described hereinabove, according to the thermal transfer line printer in accordance with the present invention, a high quality image can be formed on a transfer medium consistently and the present invention exhibits an excellent effect.

What is claimed is:

1. An intermediate transfer type thermal transfer line printer in which a primary image is formed by transferring ink of a multi-color ink sheet on an intermediate transfer sheet using a line thermal head, the primary image is retransferred on a transfer medium using a retransfer mechanism comprising a heating roller disposed so as to face to a moving path of the intermediate transfer sheet, a heating roller contact ON/OFF mechanism bringing the heating roller ON/OFF contact with the intermediate transfer sheet, and a heating roller contact ON/OFF motor driving the heating roller contact ON/OFF mechanism to thereby form a full-color image on the transfer medium, wherein the thermal transfer line printer is provided with a controller controlling the heating roller contact ON/OFF motor such that the heating roller contact ON/OFF mechanism is selectively operated at least in a weak pressure contact state in which the heating roller is in contact with the intermediate transfer sheet with a weak pressure and in a strong pressure contact state in which the heating roller is in contact with the intermediate transfer sheet with a strong pressure when retransfer is carried out.

2. The thermal transfer line printer according to claim 1, wherein the thermal transfer line printer is provided with retransfer mark detector that detects a register mark formed on the intermediate transfer sheet when retransfer is carried out, and wherein the controller controls an operation timing such that the heating roller is pressed with the weak pressure at the time before the retransfer mark detector detects the register mark and the heating roller is pressed with the strong pressure at a time after the retransfer mark detector detects the register mark when the retransfer is carried out.

* * * * *